US006269715B1

(12) United States Patent
Cagny

(10) Patent No.: US 6,269,715 B1
(45) Date of Patent: Aug. 7, 2001

(54) RATCHET-TYPE WRENCH

(75) Inventor: Jacques Cagny, Courcouronnes (FR)

(73) Assignee: FACOM, Morangis Cedex (FR)

( * ) Notice: Subject to any disclaimer, the term of this patent is extended or adjusted under 35 U.S.C. 154(b) by 0 days.

(21) Appl. No.: 09/367,230

(22) PCT Filed: Feb. 27, 1998

(86) PCT No.: PCT/FR98/00392

§ 371 Date: Aug. 11, 1999

§ 102(e) Date: Aug. 11, 1999

(87) PCT Pub. No.: WO98/38009

PCT Pub. Date: Sep. 3, 1998

(30) Foreign Application Priority Data

Feb. 28, 1997 (FR) ..... 97 02449

(51) Int. Cl.[7] ..... B25B 13/02
(52) U.S. Cl. ..... 81/119
(58) Field of Search ..... 81/119, 121.1, 81/124.3, 124.7, 125.1, 186

(56) References Cited

U.S. PATENT DOCUMENTS

| | | | |
|---|---|---|---|
| 1,936,352 | | 11/1933 | Dixon . |
| 1,954,141 | | 4/1934 | Miquelon . |
| 2,671,368 | | 3/1954 | Diebold . |
| 3,745,859 | | 7/1973 | Evans et al. . |
| 3,905,255 | * | 9/1975 | Evans ..... 81/119 |
| 4,889,020 | | 12/1989 | Baker . |
| 5,131,312 | * | 7/1992 | Macor ..... 81/119 |
| 5,406,868 | * | 4/1995 | Foster ..... 81/119 |
| 5,582,083 | * | 12/1996 | Baker ..... 81/119 |

FOREIGN PATENT DOCUMENTS

| | | |
|---|---|---|
| 857177 | 11/1952 | (DE) . |
| 0 747 173 | 12/1996 | (EP) . |
| 2 752 183 | 2/1998 | (FR) . |
| 97/00758 | 1/1997 | (WO) . |

* cited by examiner

*Primary Examiner*—Derris H. Banks
*Assistant Examiner*—Anthony Ojini
(74) *Attorney, Agent, or Firm*—Wenderoth, Lind & Ponack L.L.P.

(57) ABSTRACT

A ratchet wrench (1) with a single-piece jaw (3) having two positions for driving a hexagonal head (4), in particular of a screw or a nut. In each driving position, two opposite surfaces of the head (41,42) are driven by respective protuberances (P2, P7) of the two grips of the jaw, and a supplementary protuberance (P5) is urged in localized support in the front half of an intermediate surface (43) of the head located immediately in front of the rear surface. Thus, the inner profile of the jaw has six main protuberances, with an angular offset of 24 to 28° between two groups of three protuberances.

23 Claims, 7 Drawing Sheets

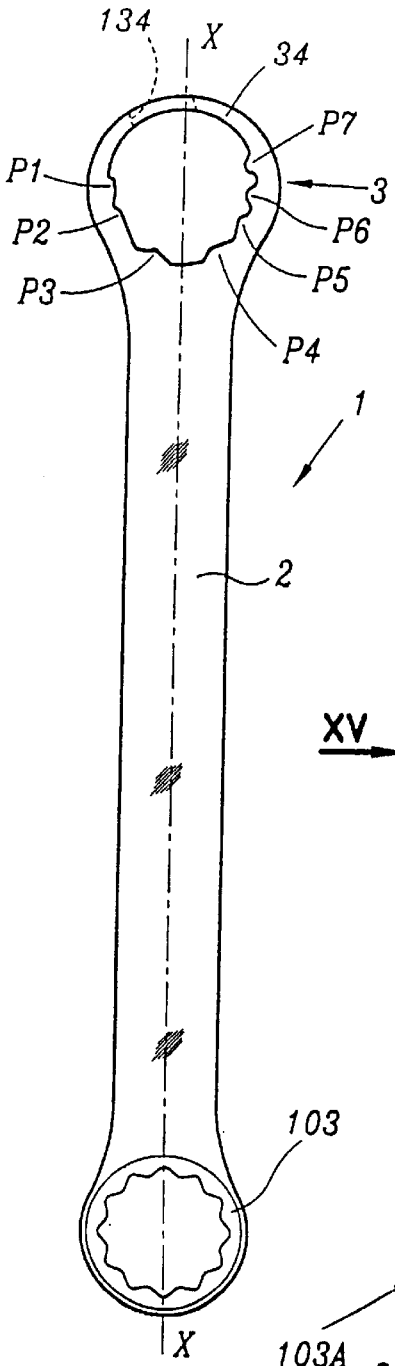
FIG. 13
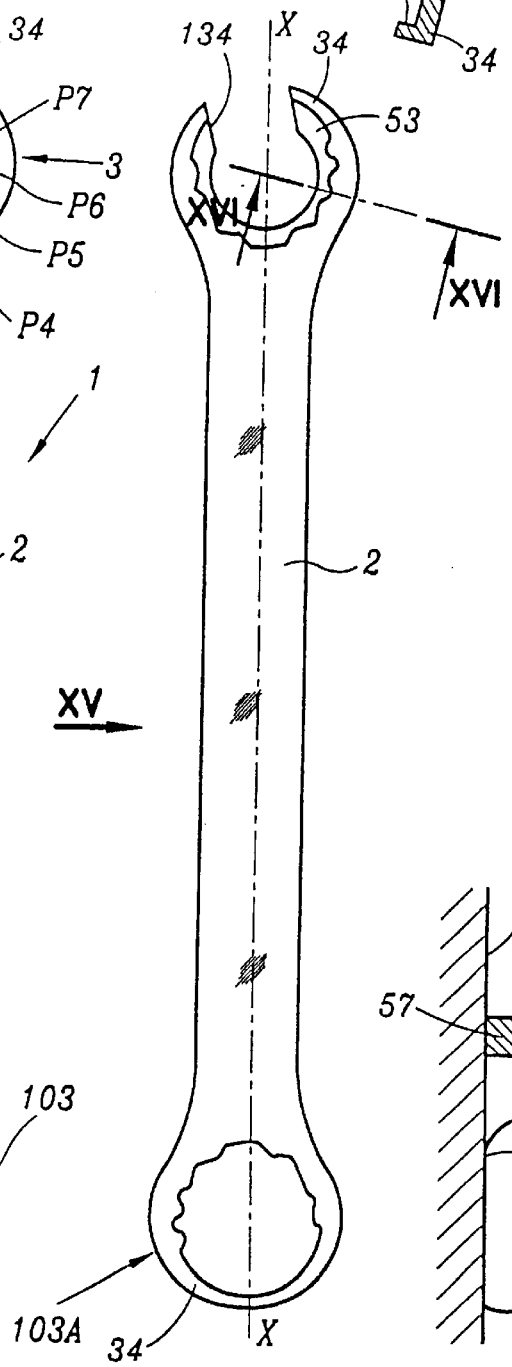
FIG. 14
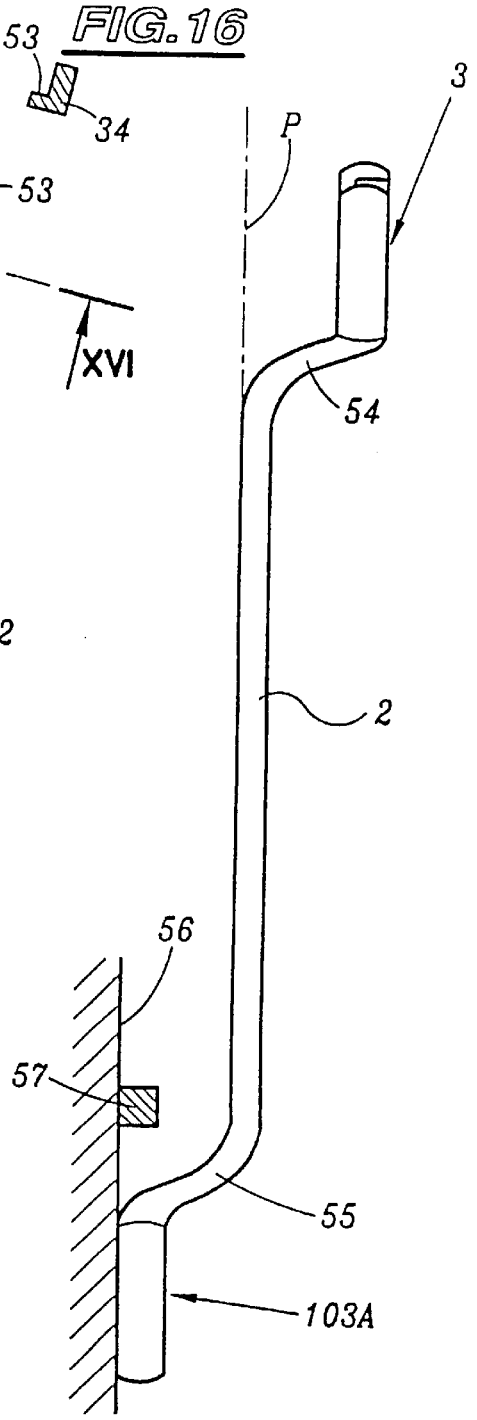
FIG. 15
FIG. 16

RATCHET-TYPE WRENCH

BACKGROUND OF THE INVENTION

This invention relates to a ratchet-type wrench for driving a component, particularly a screw or a nut, the head of which has a hexagonal drive profile.

Patent Application PCT/FR 96/00 963, in the name of the Applicant Company, describes a ratchet-type wrench, which is particular easy and stable to use and which drives a hexagonal head with good protection.

However, in this known ratchet-type wrench, the backing-off movement of the ratchet between two driving positions extends angularly over 60°, whereas certain working environments do not offer enough empty space for movement of such an amplitude.

Ratchet-type wrenches with a backing-off movement on the order of 30° have been proposed in U.S. Pat. No. 4,889,020, but with serious drawbacks. Specifically, if the wrench is a one-piece wrench, the user has to shift the wrench radially with respect to the head in order to reach the second driving position, which is something that is difficult to achieve. Such shifting can be avoided only at the cost of adding an elastically loaded sliding finger.

SUMMARY OF THE INVENTION

The object of the present invention is to provide a ratchet-type wrench with one-piece pair of jaws that are capable of ratcheting with a backing-off movement on the order of 30° while constantly being pushed toward the axis of the hexagonal head.

To this end, the subject of the present invention is a ratchet-type wrench of the aforementioned type.

BRIEF DESCRIPTION OF THE DRAWINGS

An embodiment of the present invention will now be described with reference to the appended drawings, in which:

FIG. 13 depicts an alternative form of the ratchet-type wrench, in plan view;

FIG. 14 depicts a plan view of another alternative form of the ratchet-type wrench;

FIG. 15 is a side view taken in the direction of arrow XV of FIG. 14; and FIG. 16 is a partial sectional view taken on the line XVI—XVI of FIG. 4.

DETAILED DESCRIPTION OF THE INVENTION

Figure 1:
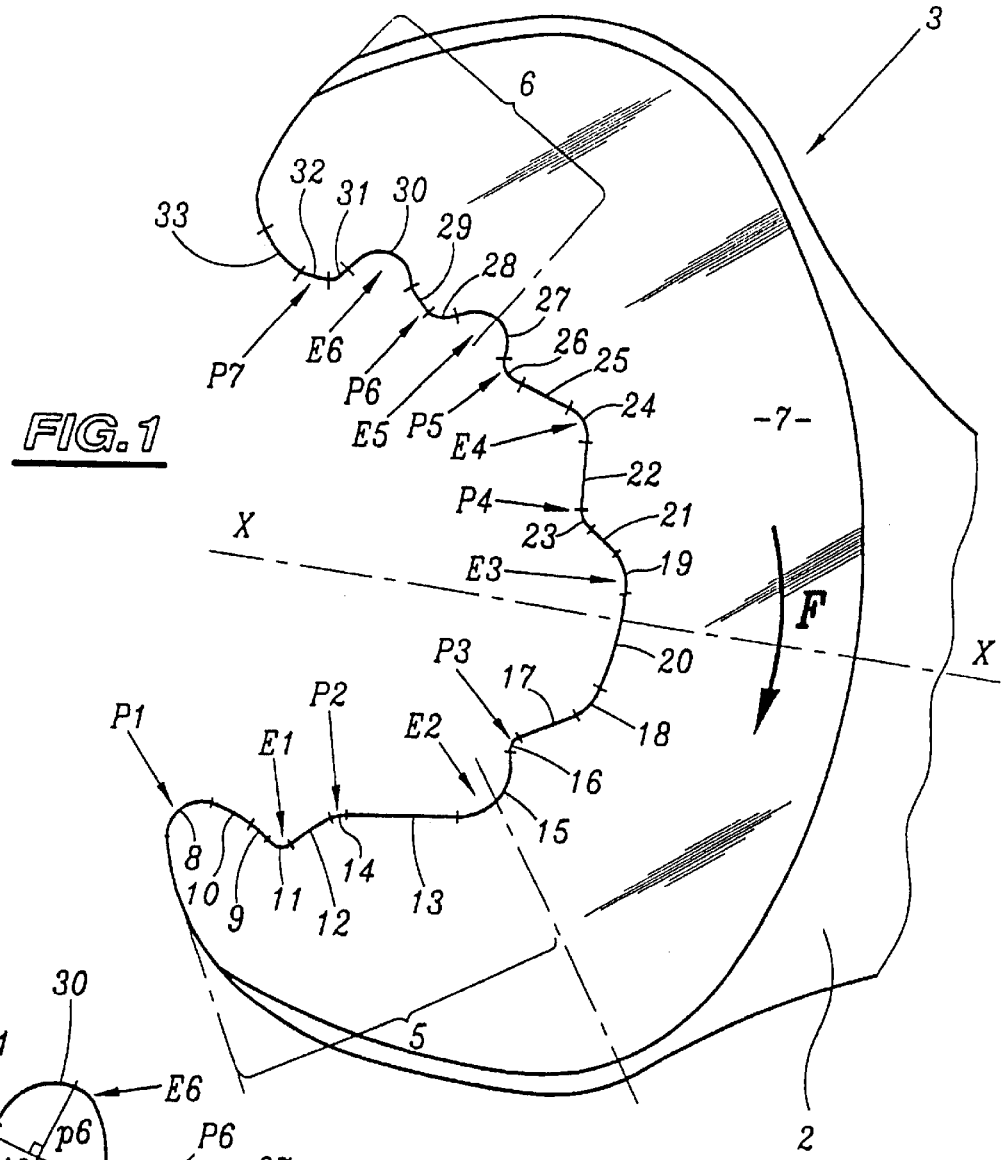
FIG. 1 is a partial view of a ratchet-type wrench constructed in accordance with the invention.

The ratchet-type wrench 1 depicted in FIG. 1 is a one-piece steel component having a flat overall shape. The wrench comprises a handle 2 of elongate shape, of overall axis X-X, which widens at its distal end to form a driving pair of jaws 3. At its other end, the handle 2 may form another driving head, either similar to the pair of jaws 3 but of a different size, or of any other known type, particularly of the open-ended or ring wrench type, indicated by reference numeral 103 as shown in FIG. 13.

The pair of jaws 3 is intended to drive a hexagonal head 4, shown in FIGS. 3 to 12, which is assumed to be a nut, in the clockwise direction F. In what follows, the terms "front" and "rear", "advance" and "back-off" refer to this direction of driving.

The pair of jaws 3 may be considered as made up of three regions: a front jaw 5, a rear jaw 6, and an intermediate bow 7 which connects these two jaws. The interior profile of these three regions will be described below.

The front jaw 5 comprises two protrusions, namely a front protrusion P1 and a rear protrusion P2, separated by a recess E1.

The rear jaw 6 comprises two protrusions, namely a front protrusion P6 and a rear protrusion P7, separated by a recess E6.

The intermediate bow 7 comprises three protrusions, namely a front protrusion P3, an intermediate protrusion P4 and a rear protrusion P5. A recess E2 separates the protrusion P2 from the protrusion P3, and likewise a recess E3 separates the protrusion P3 from the protrusion P4 and a recess E4 separates the protrusion P4 from the protrusion P5.

Thus, the pair of jaws 3 has, from front to rear, seven successive protrusions P1 to P7, separated by six successive recesses El to E6. In this example, the term "protrusion" should be understood as meaning a part which is convex in profile, and the term "recess" should be understood as meaning a concave part.

Going into greater detail, from front to rear:

Protrusion P1 consists successively of two rounded portions 8 and 9 of similar radii, connected by a rounded portion 10 of a far larger radius;

Recess E1 is formed of a simple rounded portion 11 of small radius;

Protrusion P2 has a substantially triangular overall shape, with two flanks, a front flank 12 of large radius and a rear flank 13 which is substantially straight, connected by a rounded portion 14 of small radius;

Recess E2 consists of a simple rounded portion 15;

Protrusion P3 consists of a rounded portion 16 of small radius connected directly to the recess E2, and a substantially straight rear flank 17;

Recess E3 consists of two rounded portions 18 and 19 connected by a bottom 20 of large radius;

Protrusion P4 has a substantially triangular overall shape with two flanks—front 21 and rear 22—which are substantially straight and connected by a rounded portion 23 of small radius;

Recess E4 is a simple rounded portion 24;

Protrusion P5 consists of a substantially straight front flank 25 followed by a rounded portion 26;

Recess E5 is a simple rounded portion 27;

Protrusion P6 consists of a rounded portion 28 followed by a substantially straight segment 29;

Recess E6 is a simple rounded portion 30; and

Protrusion P7 consists of a rounded portion 31 followed by a substantially straight segment 32 then by a rounded portion 33.

All of the portions 8 to 33 of the profile meet at a tangent to one another, with the exception of the connections between 29 and 30 and between 32 and 33 which require additional small-radius blend radii.

Figure 2:
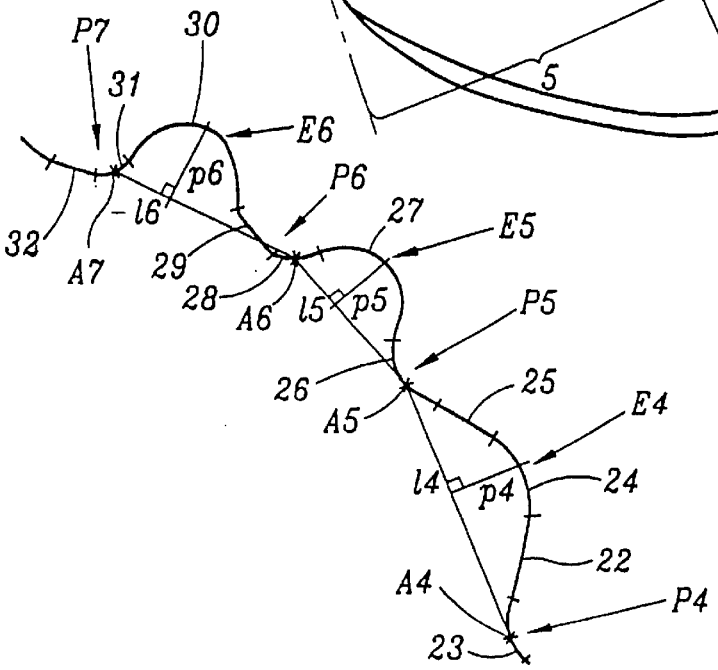
FIG. 2 depicts a portion of the interior profile of a pair of jaws of the wrench shown in FIG. 1, on an enlarged scale.

The regions P4 to P7 of the profile are depicted on an enlarged scale in FIG. 2.

The middles of the rounded portions 23, 26, 28 and 31 of the protrusions P4 to P7 are denoted A4 to A7 respectively, and these four points are substantially the points of contact of the four protrusions with the faces of the nut during the driving phases which will be described later. In addition, the maximum depths of the recesses E4 to E6, measured at right angles to the segments P4–P5, P5–P6 and P6–P7, are denoted p4 to p6 respectively, and the lengths of these three segments are denoted 14, 15 and 16. This then gives the following dimensional relationships:

$$0.27\ 14 \leqq p4 \leqq 0.40\ 14$$

$$0.25\ 15 \leqq p5 \leqq 0.33\ 15$$

$$0.30\ 16 \leqq p6 \leqq 0.40\ 16$$

In the illustrated example, the pair of jaws 3 is in the overall shape of a fork which is open at the front. As an alternative, as illustrated in FIG. 13, it could be completed by a stiffening front bow 34, so as to form a ring. In this case, and as shown in the dotted line, the bow 34 may have a break 134 intended to permit the passage of a shank or a tube connected to the nut 4. The bow 34 does not come into contact with the nut in the driving positions of the wrench which are described later, nor during the backing-off movements of the wrench when the wrench is pushed toward the nut along the axis X-X of its handle.

The way in which the wrench works will now be described with reference to FIGS. 3 to 12. The example is given for a wrench of a minimum size and a nut of a maximum size, taking manufacturing tolerances into account, that is to say, the most unfavorable case for correct achievement of the backing-off movements. It should be noted that the difficulty lies in simultaneously obtaining good conditions for driving nuts of the minimum size and backing-off or ratchet movements without jamming on nuts of the maximum size. It should be understood that, as far as the nuts are concerned, the expressions "minimum size" and "maximum size" are understood within the context of the standardization of nuts. In all of FIGS. 3 to 12, the nut 4 is depicted in the same position.

Figure 3:
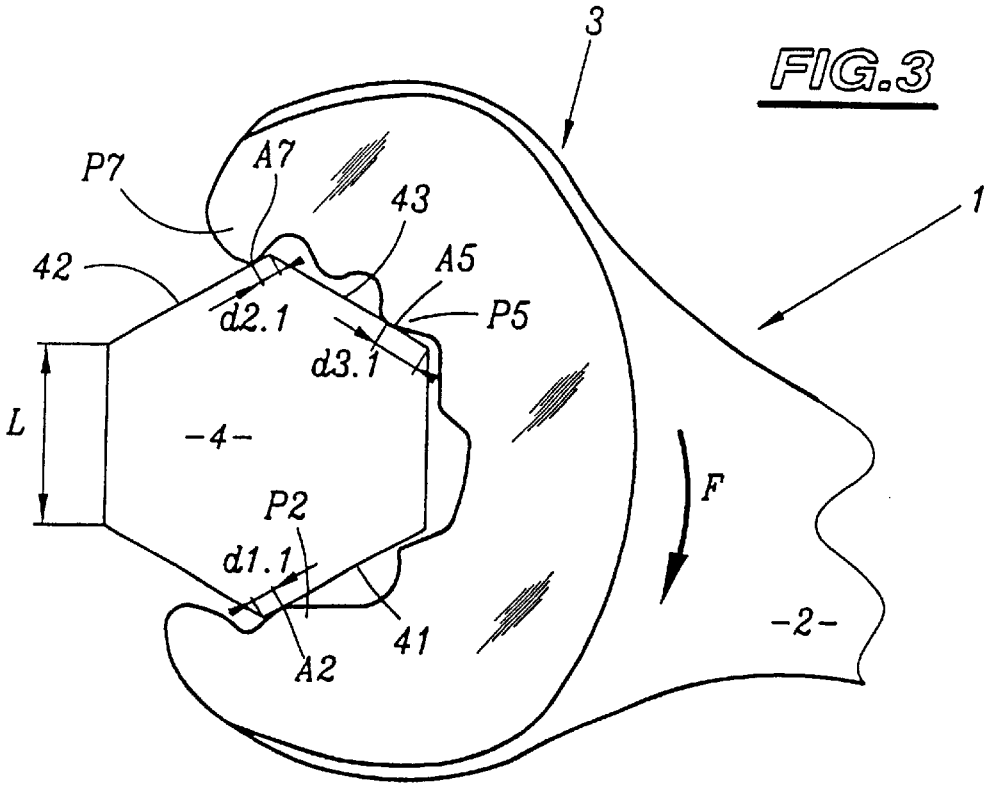
FIG. 3 depicts the ratchet-type wrench, engaged with a hexagonal nut, in a first driving position.

FIG. 3 depicts the wrench in its first driving position. According to the teaching of the aforementioned PCT/FR application, for zero torque and for any driving torque, that is to say applied in the clockwise direction F, the pair of jaws 3 is in contact with the nut 4 at just three points: two driving points consisting of a point A2 of the protrusion P2 and the point A7, and an additional bearing point consisting of the point A5. The point A2 lies in the front or forward half of the front face 41, and the point A7 lies in the front or forward half of the diametrically opposite rear face 42, while the point A5 lies in the front or forward half of the face 43 located immediately ahead of the face 42.

In the first driving position, if d1.1, d2.1 and d3.1 are used to denote the distances from each point of contact A2, A7, A5 to the front corner of the corresponding face, and if L is used to denote the length of one side of the nut, then this gives the following relationships:

$$d2.1 > d1.1;$$

$$d3.1 > d1.1;$$

$$d3.1 > d2.1;$$

and $$0.25L \leqq d3.1 \leqq 0.29L.$$

When the driving travel has been completed, the operator executes a movement of backing-off the wrench, that is to say of moving the wrench in the counterclockwise direction F1, as illustrated in FIGS. 4 to 7, in which the contacts mentioned serve to guide the wrench over the nut. It is assumed that a light force is constantly applied to the wrench along the axis X-X of the handle 2 toward the nut (f in FIG. 4).

Figure 4:
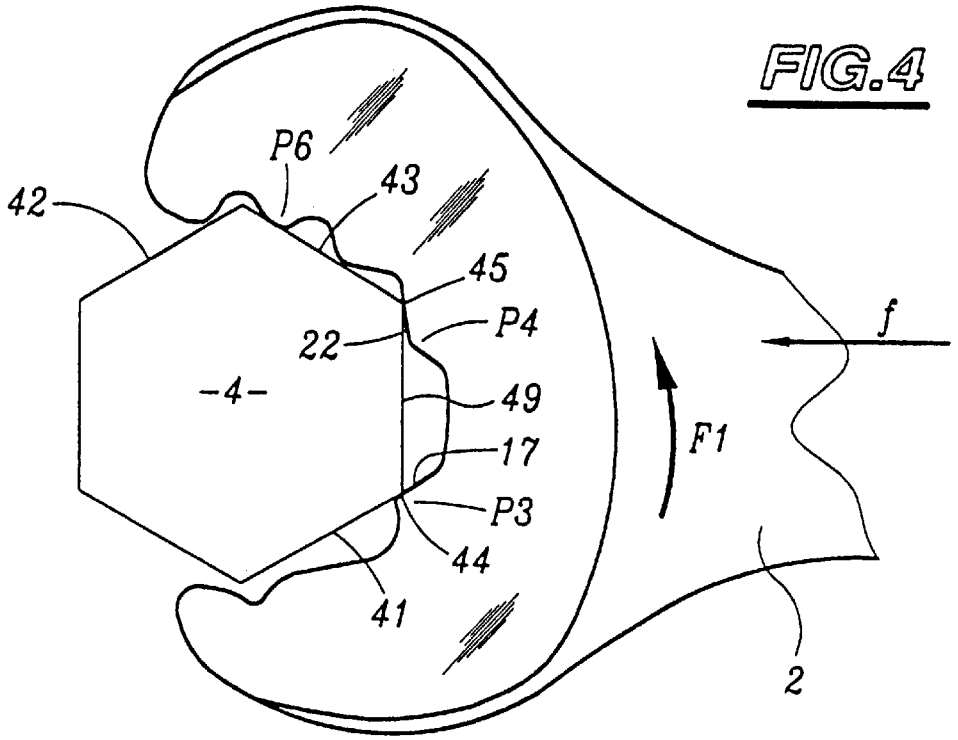
FIGS. 4 to 7 depict five successive phases of a backing-off movement of the wrench from a first driving position to a second driving position.

As shown in FIG. 4: the rear flank 17 of the protrusion P3 comes into contact with the face 41 near to its rear corner 44; rear flank 22 of the protrusion P4 comes into contact with the rear corner 45 of the face 49 that lies between the faces 41 and 43; and the protrusion P6 comes into contact with the rear region of the face 43.

Figure 5:
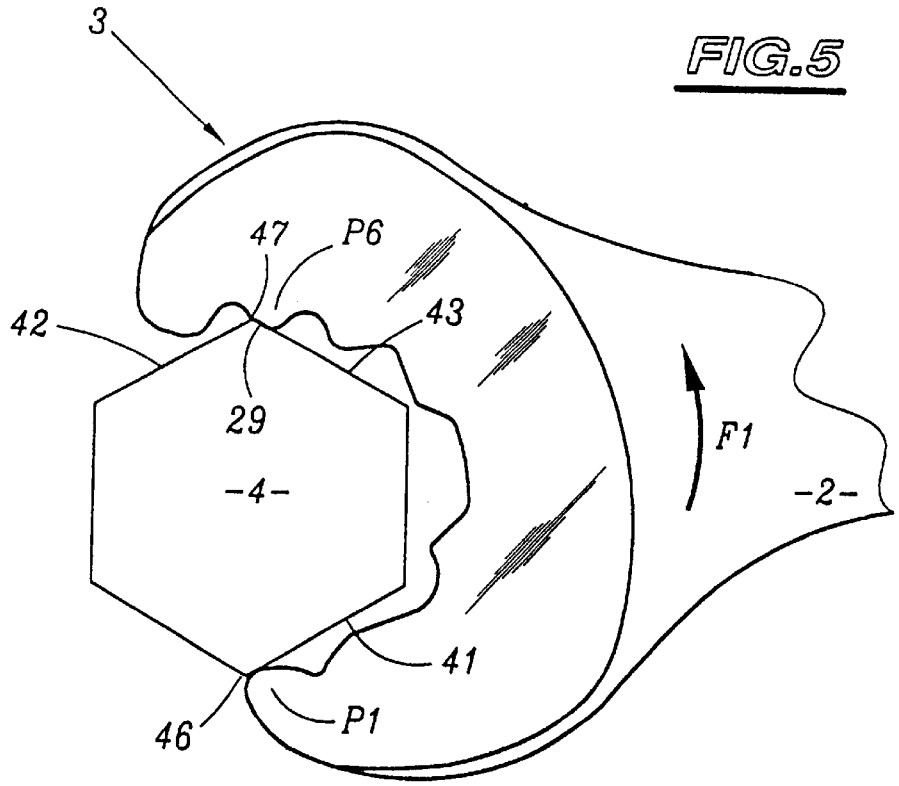

As shown in FIG. 5: the protrusion P1 comes into contact with the front part of the face 41, near to its front corner 46, and the straight-line segment 29 of the protrusion P6 presses against the face 43 near rear corner 47.

Figure 6:
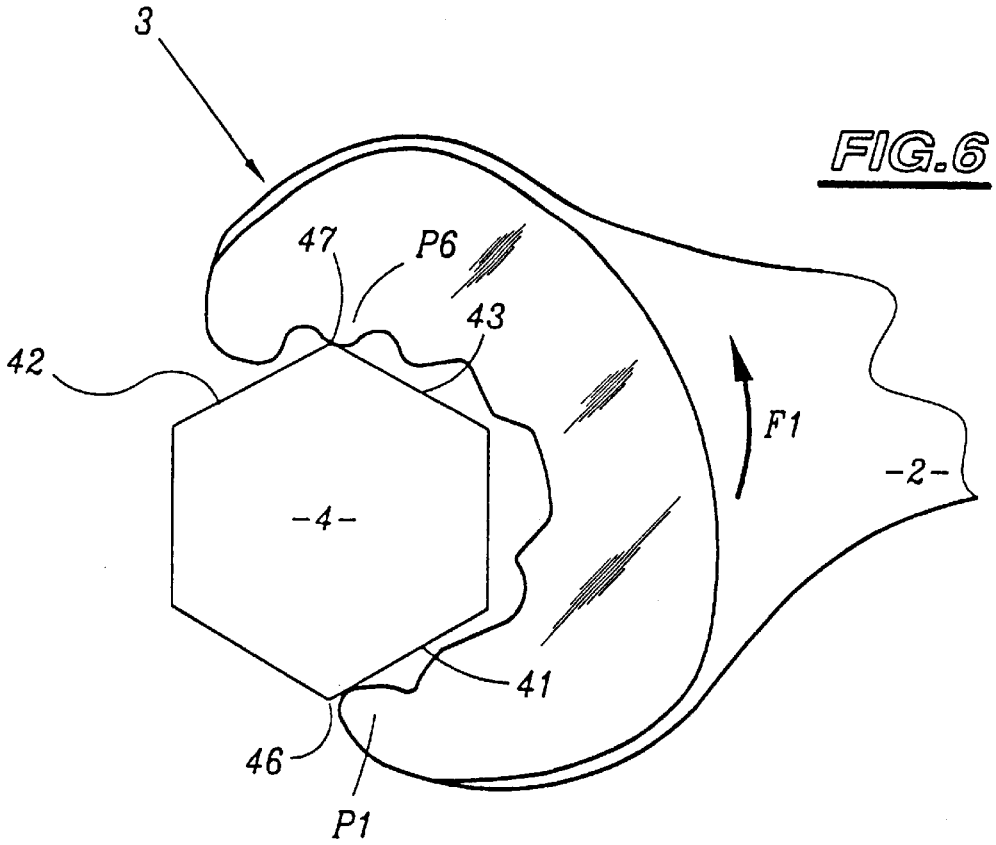

As shown in FIG. 6: the illustrated configuration is similar to that of FIG. 5, but the corner 47 moves past the vertex of the protrusion P6.

Figure 7:
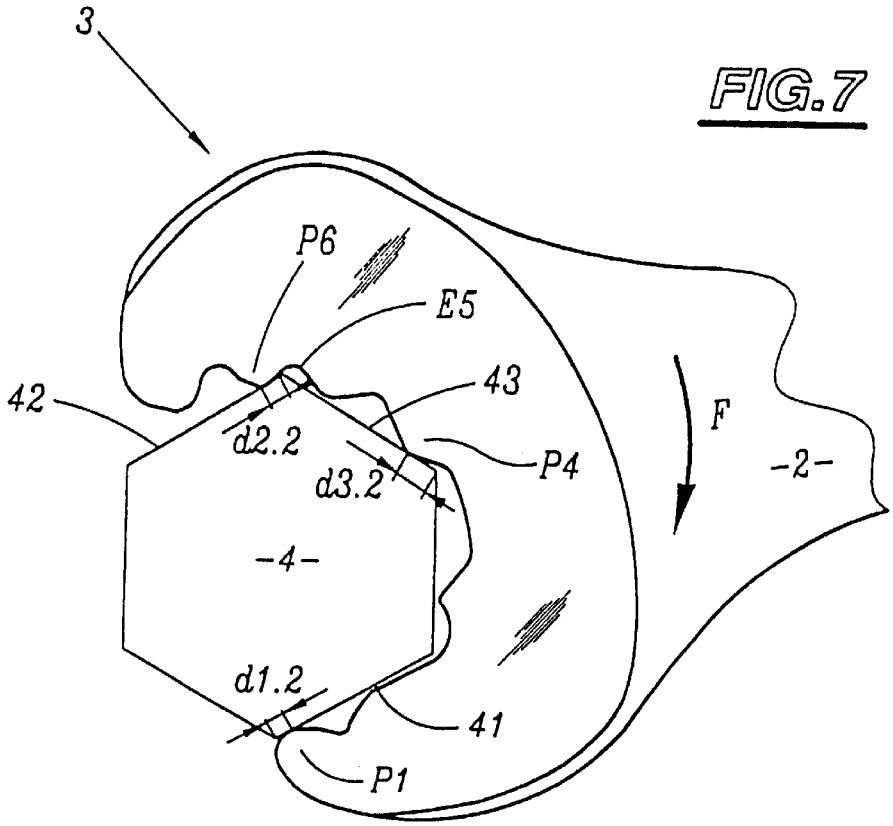

As shown in FIG. 7: the corner 47 enters the recess E5, and there are once more three points of contact P1-41, P4-43 and P6-42, the three points of contact taking place in the front half of the faces in question. This is the second driving position, similar to that of FIG. 1 but angularly offset by 26° in the counterclockwise direction F1 with respect to the axis of the nut.

In this position, if d1.2, d2.2 and d3.2 are used to denote the distances from each point of contact to the front corner of the corresponding face, then the following relationships are obtained:

$$d2.2 > d1.2;$$

$$d3.2 > d1.2;$$

$$d3.2 > d2.2;$$

and $$0.11L \leqq d3.2 \leqq 0.17L.$$

Figure 8:
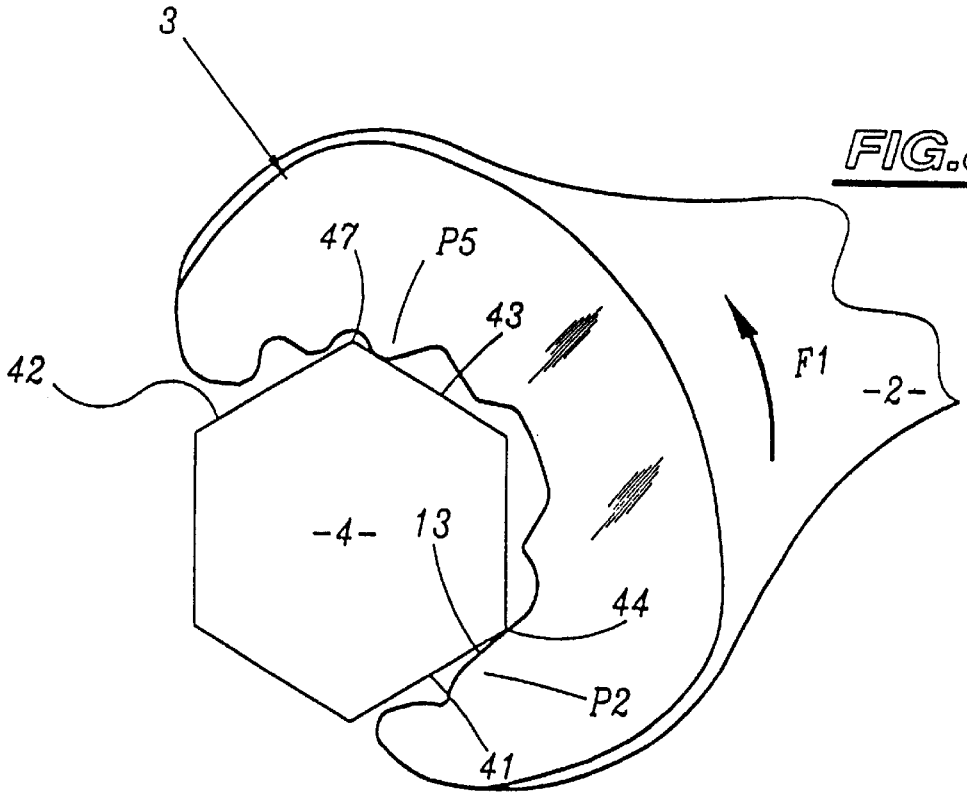
FIGS. 8 to 12 depict five successive phases of the backing-off movement of the wrench from the second driving position to the first driving position.

In this position of FIG. 7, torque can once again be applied in the direction F. The operator then once more backs-off the wrench, as illustrated in FIGS. 8 to 12:

As shown in FIG. 8: there are just two guiding contacts, namely that of the rear flank 13 of the protrusion P2 on the rear corner 44 of the face 41, and that of the protrusion P5 on the rear part of the face 43.

Figure 9:
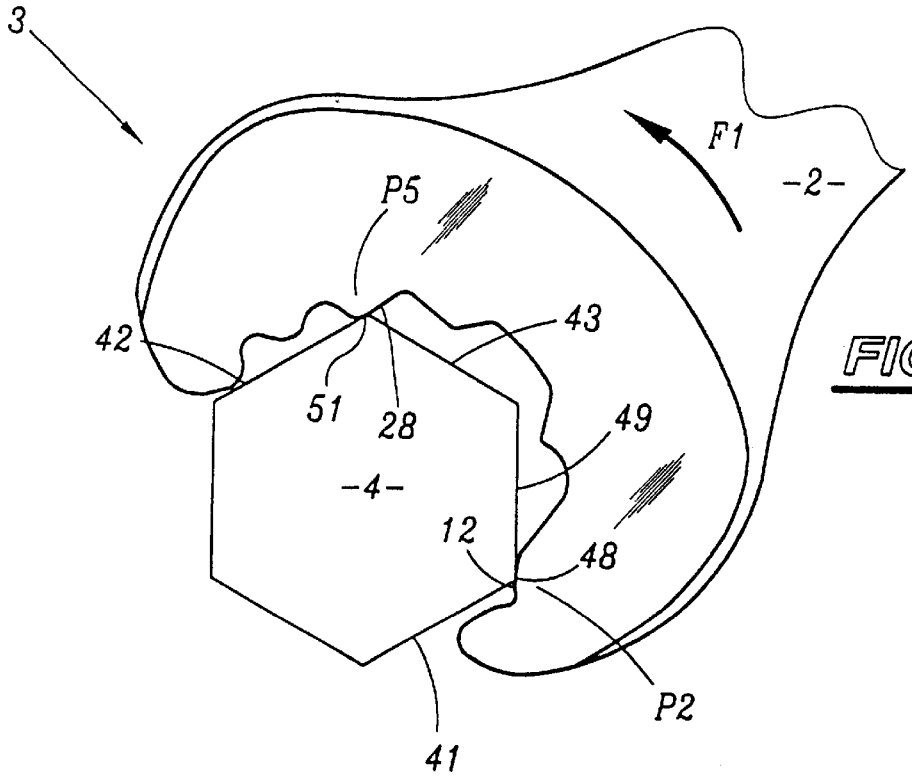

As shown in FIG. 9: there are just two guiding contacts, namely that of the front face 28 of the protrusion P5 on the front corner 51 of the face 42 and that of the front flank 12 of the protrusion P2 on the front corner 48 of the face 49 of the nut, which face lies between the faces 41 and 42.

Figure 10:
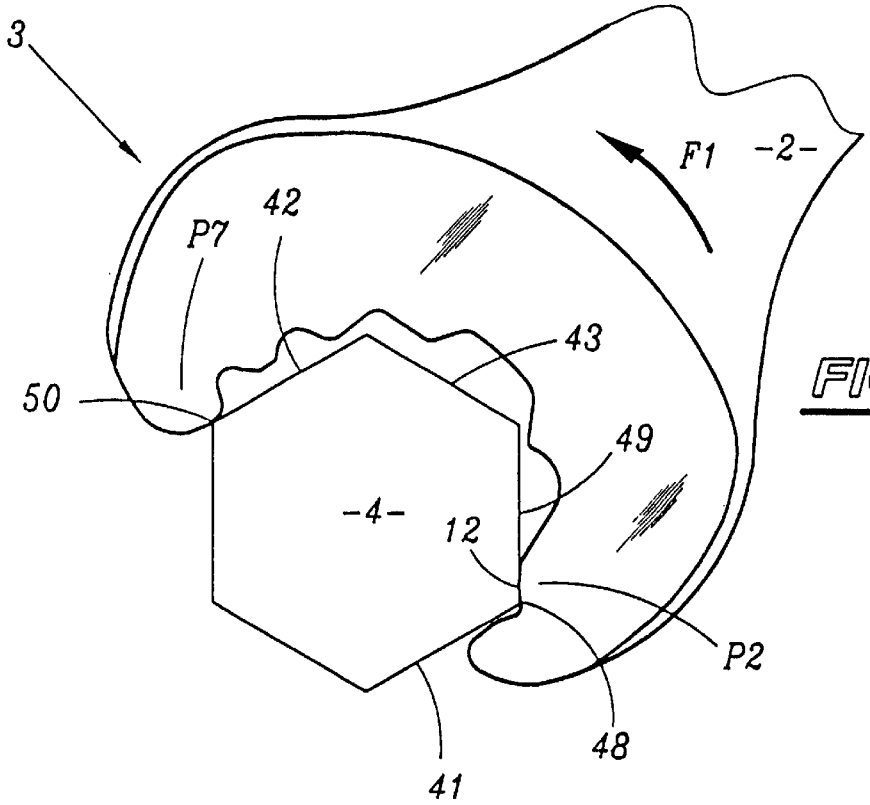

As shown in FIG. 10: there are just two guiding contacts, namely that of the front flank 12 of the protrusion P2 on the front region of the face 49, and that of the protrusion P7 on the rear corner 50 of the face 42.

Figure 11:
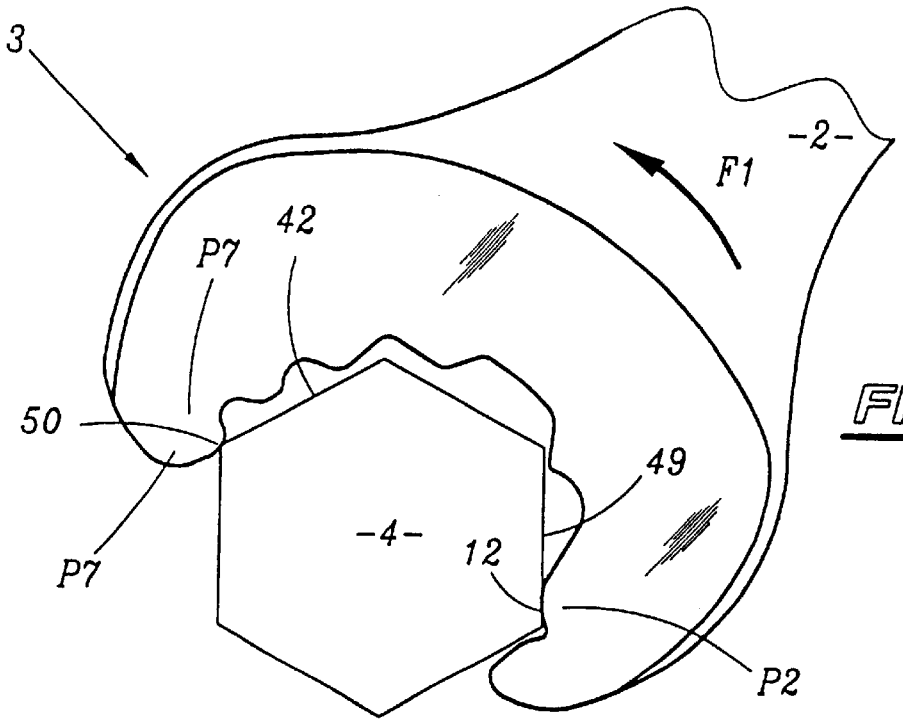

As shown in FIG. 11: in a similar configuration to the configuration of FIG. 10, the protrusion P7 pivots about the corner 50.

Figure 12:
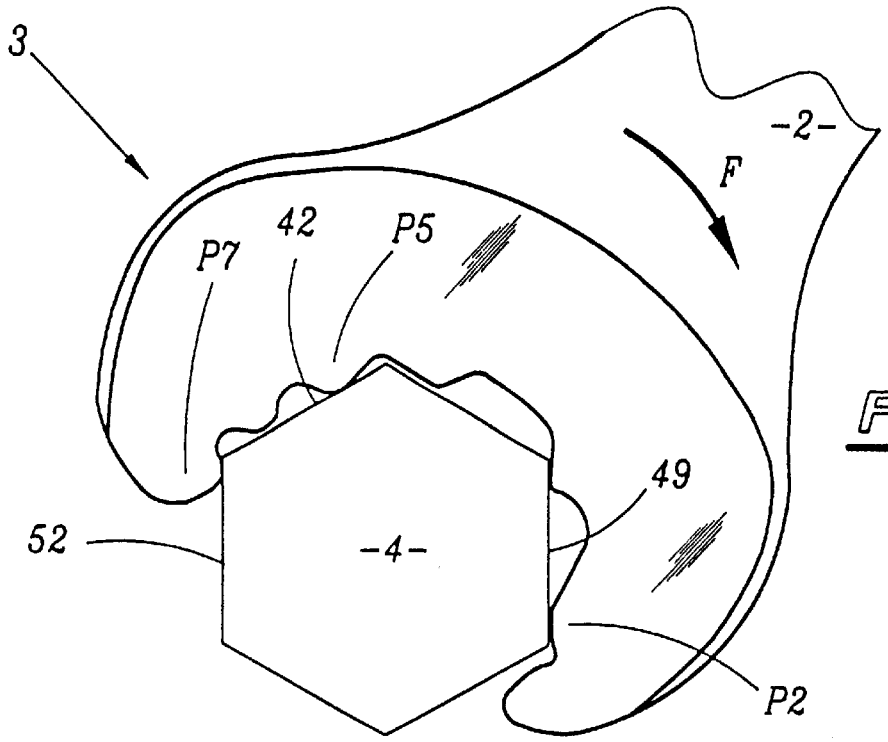

As shown in FIG. 12: the protrusion P7, having passed the corner 50, comes to bear against the front part of the face 52 which lies immediately to the rear of the face 42, and the protrusion P5 comes to bear on the front part of this face 42. The contact between P2 and 49 is maintained.

This is then a return to a position that is identical to that of FIG. 3, that is to say to the first driving position, but with a backward angular offset of 60° compared with the position of FIG. 3.

The second backing-off of the wrench, from the second driving position (FIG. 7) to the first driving position (FIG. 12) has the angular amplitude of 60−26=34°.

By virtue of the configuration of the protrusions and of the recesses as described above, the corners of the nut are not in contact with the wrench during the driving phases, and no jamming occurs during the backing-off or ratchet phases.

It should be noted that, for certain ratios of jaw and nut size, the protrusion P3 does not play any part during the backing-off movements, depending on the manufacturing tolerances. By contrast, all the other guide surfaces of the protrusions P1, P2 and P4 to P7 are always used at least once during at least one of the backing-off movements. More specifically, when backing-off from the first position to the second position the wrench is guided by the protrusions used for driving in the second position, and likewise, when backing-off from the second position to the first position, the wrench is guided by the protrusions used for driving in the first position.

The alternative form of the present invention, as shown in FIGS. 14 to 16, differs from the form of FIG. 13 in the following respects.

On the one hand, the front bow 34, broken at 134, is reinforced by a web 53, which is an annular internal collar adjacent to one face of the pair of jaws and contains a break like the bow 34, as is known per se.

Furthermore, as shown in FIG. 15, the handle is doubly cranked. One end of the handle has an oblique section 54 which extends as far as the web 53, and at the other end the handle has an oblique section 55, which is substantially parallel to the section 54 and diverges from the overall plane P of the handle in the opposite direction.

Finally, the second driving head 103A is parallel to the plane P, as is the pair of jaws 3, and is identical to the pair of jaws 3 of FIG. 13, with the bow 34 being continuous.

The orientation of the protrusions of the head 103A is such that the head drives in the counterclockwise direction and ratchets in the clockwise direction, in the position of FIG. 15 in which it is pressed flat against a surface 56, with the cranked portion 55 avoiding any obstacles 57 that may be projecting from this surface. Once the wrench has been turned over with respect to the plane P, the pair of jaws 3, on the other hand, is capable of driving in the clockwise direction and ratchets in the counterclockwise direction, as described above.

What is claimed is:

1. A ratchet-type wrench for driving a component having a head defining a hexagonal driving profile, said wrench comprising:

a handle; and a one-piece pair of jaws connected to an end of said handle, said pair of jaws including, with respect to a driving direction of said pair of jaws, a front jaw, a rear jaw, and a connecting bow connecting said front and rear jaws, said front jaw comprising a first protrusion adapted to cooperate with a forward portion of a front face of the hexagonal driving profile in a first driving position of the wrench, said rear jaw comprising a first protrusion adapted to cooperate with a forward portion of a rear face of the hexagonal driving profile in the first driving position of the wrench, wherein the front and rear faces are in opposite positions on the hexagonal driving profile of the head, said connecting bow defining a first protrusion adapted to bear on, in the absence of torque and during application of a driving torque, a bearing point of an intermediate face of the hexagonal driving profile, the intermediate face lying immediately forward of the rear face of the hexagonal driving profile with respect to the drive direction of said pair of jaws, the bearing point of the intermediate face being located in a forward half of the intermediate face, said connecting bow being spaced away from the head at every point other than at the bearing point in the absence of torque and during application of a driving torque, wherein:

said front jaw further comprises a second protrusion adapted to cooperate with a front face of the hexagonal profile in a second driving position of the wrench;

said rear jaw further comprises a second protrusion adapted to cooperate with a rear face of the hexagonal profile in the second driving position of the wrench;

said connecting bow further comprises a second protrusion adapted to bear on a bearing point of an intermediate face of the hexagonal profile in the second driving position in the absence of torque and during application of a driving torque, the bearing point of the second protrusion of the connecting bow being located in a forward half of the intermediate face, wherein said connecting bow is completely spaced away from the hexagonal head at every point other than at the bearing point, in the second driving position, in the absence of torque and during application of a driving torque; and the points of contact in the first driving position, which is defined by contact of said first protrusions with the hexagonal driving profile of the head, are offset by an angle A that is substantially 24 to 28° relative to the points of contact in the second driving position, which is defined by contact of said second protrusions with the hexagonal driving profile of the head, so that a change from the first driving position to the second driving position is achieved by rotating the wrench backward through the angle A, and a change from the second driving position to the first driving position is achieved by rotating the wrench backward through an angle that is equal to 60° minus the angle A.

2. A ratchet-type wrench as claimed in claim 1, wherein the component to be driven is a screw or a nut, the first and second protrusions defined by said connecting bow are domed protrusions, and the angle A is equal to 26°.

3. A ratchet-type wrench as claimed in claim 1, wherein each of said protrusions are rounded at their region of contact with the corresponding faces of the hexagonal head when the wrench is in the first and second driving positions.

4. A ratchet-type wrench as claimed in claim 1, wherein each of said first and second protrusions of said rear jaw has a rear flank that defines a substantially straight face.

5. A ratchet-type wrench as claimed in claim 1, wherein, in the first driving position, the contact point of said first protrusion of said rear jaw is spaced from a forward corner of the rear face of the hexagonal driving profile of the head by a distance d2, and the contact point of said first protrusion of said front jaw is spaced from a forward corner of the front face of the hexagonal driving profile of the head by a distance d1, and the distance d2 is greater than the distance d1, and wherein, in said second driving position, the contact point of said second protrusion of said rear jaw is spaced from a forward corner of the rear face of the hexagonal driving profile of the head by a distance d4, and the contact point of said second protrusion of said front jaw is spaced from the forward corner of the front face of the hexagonal driving profile of the head by a distance d3, and the distance d4 is greater than the distance d3.

6. A ratchet-type wrench as claimed in claim 1, wherein a distance between the bearing point of said first protrusion of said connecting bow and a forward corner of the intermediate face is between 0.25 L and 0.29 L, where L is the length of a side of the hexagonal driving profile of the head.

7. A ratchet-type wrench as claimed in claim 1, wherein a distance between the bearing point of second protrusion of said connecting bow and a forward corner of said intermediate face is between substantially 0.11 L and 0.17 L, where L is the length of a side of the hexagonal driving profile of the head.

8. A ratchet-type wrench as claimed in claim 1, wherein, in the first driving position, a distance between the bearing point and a front corner of the intermediate face is greater than a distance between the point of contact of said first protrusion of said front jaw with the front face of the hexagonal driving profile of the head and a front corner of the front face, and wherein, in the second driving position, the distance between the bearing point and the front corner of the intermediate face of the hexagonal driving profile of the head is greater than the distance between the point of contact of said second protrusion of said front jaw with the front face of the hexagonal driving profile of the head and the front corner of the front face.

9. A ratchet-type wrench as claimed in claim 1, wherein, in the first driving position, a distance between the bearing point and a front corner of the intermediate face is greater than a distance between the point of contact of said first protrusion of said rear jaw with the rear face of the hexagonal driving profile of the head and a front corner of the rear face, and wherein, in the second driving position, the distance between the bearing point and the front corner of the intermediate face of the hexagonal driving profile of the head is greater than the distance between the point of contact of said second protrusion of said rear jaw with the rear face of the hexagonal driving profile of the head and the front corner of the rear face.

10. A ratchet-type wrench as claimed in claim 1, wherein said pair of jaws further comprises another protrusion located between said first protrusion of said front jaw and said second protrusion of said connecting bow, said another protrusion having no active front flank and having a rear flank forming a surface for guiding the wrench during at least one backing-off movement of the wrench, for at least some sizes of the head and said jaws.

11. A ratchet-type wrench as claimed in claim 10, wherein, each of said protrusions is operable to provide guidance for the wrench during at least one backing-off movement of the wrench, for at least for some sizes of said jaws and the head.

12. A ratchet-type wrench as claimed in claim 1, wherein when backing off from the first driving position to the second driving position, the wrench is guided by said second protrusions, which are used for driving in the second driving position, and, when backing off from the second driving position to the first driving position, the wrench is guided by said first protrusions, which are used for driving in the first driving position.

13. A ratchet-type wrench as claimed in claim 1, wherein between said first protrusion of said rear jaw and said second protrusion of said rear jaw there is a recess having a depth that is between substantially 0.3×1 and 0.4×1, where 1 is a distance between the points of driving contact of said first protrusion of said rear jaw and said second protrusion of said rear jaw with the head.

14. A ratchet-type wrench as claimed in claim 1, wherein between said second protrusion of said rear jaw and said first protrusion of said connecting bow there is a recess having a depth that is between substantially 0.25×1 and 0.33×1, where 1 denotes a distance between the points of driving contact of said second protrusion of said rear jaw and said first protrusion of said connecting bow with the head.

15. A ratchet-type wrench as claimed in claim 1, wherein between said first protrusion of said connecting bow and said second protrusion of said connecting bow there is a recess having a depth that is between substantially 0.27×1 and 0.40×1, where 1 denotes a distance between the points of driving contact of said first and second protrusions of said connecting bow with the head.

16. A ratchet-type wrench as claimed in claim 1, wherein said pair of jaws forms an open fork.

17. A ratchet-type wrench as claimed in claim 1, wherein said pair of jaws is closed by a front bow so as to form a ring, said front bow being shaped in such a way as to avoid any contact with the hexagonal driving profile of the head at each of the first and second driving positions and during backing-off movements of the wrench, when the wrench is being pushed toward the hexagonal driving profile of the head along a longitudinal axis of said handle.

18. A ratchet-type wrench as claimed in claim 17, wherein said front bow has a break for allowing the passage of a shank or a tube connected to the head.

19. A ratchet-type wrench as claimed in claim 11, further comprising a second pair of jaws connected to the other end of said handle, wherein said second pair of jaws is of the same or a different size relative to said first pair of jaws.

20. A ratchet-type wrench as claimed in claim 19, wherein said second pair of jaws is the same size as the first pair of jaws but is capable of driving the head in an opposite direction relative to the drive direction of said first pair of jaws.

21. A ratchet-type wrench as claimed in claim 19, wherein said handle is cranked near said one of said first and second pairs of jaws and, at least one of said first and second pairs of jaws has a web for indicating an orientation with which the one pair of jaws is to be placed over the head.

22. A ratchet-type wrench as claimed in claim 1, further comprising a second pair of jaws connected to the other end of said handle, wherein said second pair of jaws defines a driving head that is of a different type relative to said first pair of jaws.

23. A ratchet-type wrench as claimed in claim 22, wherein said second pair of jaws defines an open-ended or a ring-type wrench.

* * * * *